United States Patent [19]

Caccialupi

[11] Patent Number: 4,986,067

[45] Date of Patent: Jan. 22, 1991

[54] PROCESS FOR THE PRODUCTION OF CHAINS AND OTHER ORNAMENTAL ITEMS MADE OF A LINED TUBE BAR AND OF SIMILAR OBJECTS

[76] Inventor: Gianfranco Caccialupi, 136 loc. Fossaccio, frz. Alberoro, 52048 Monte S. Savino, Arezzo (I), Italy

[21] Appl. No.: 355,973

[22] Filed: May 23, 1989

[30] Foreign Application Priority Data

Sep. 5, 1988 [IT] Italy ..... 1234 A/88

[51] Int. Cl.[5] ..... B21L 3/00

[52] U.S. Cl. ..... 59/3; 59/35.1; 59/78; 59/80; 59/83; 29/160.6; 29/517; 29/520

[58] Field of Search ..... 59/1, 3, 8, 12, 35.1, 59/78, 80, 83; 29/160.6, 517, 519, 520, 516; 140/112

[56] References Cited

U.S. PATENT DOCUMENTS

| | | | |
|---|---|---|---|
| 550,705 | 12/1895 | Williams | 29/517 |
| 831,887 | 9/1906 | Nicholson | 29/517 |
| 944,650 | 12/1909 | Ungerer et al. | 59/1 |
| 1,196,010 | 8/1916 | Merritt | 59/35.1 |
| 1,227,346 | 5/1917 | Trood et al. | 29/517 |
| 1,610,225 | 12/1926 | Metcalf | 29/160.6 |
| 1,700,533 | 1/1929 | Jennings | 59/35.1 |
| 2,425,299 | 8/1947 | Ballou, Jr. | 29/160.6 |
| 3,949,466 | 4/1976 | O'Brien et al. | 29/520 |

FOREIGN PATENT DOCUMENTS

| | | | |
|---|---|---|---|
| 2243819 | 3/1973 | Fed. Rep. of Germany | 140/112 |
| 0019678 | 8/1968 | Japan | 59/35.1 |
| 0052770 | 4/1977 | Japan | 29/160.6 |
| 0070861 | 6/1978 | Japan | 59/3 |
| 0604599 | 9/1978 | Switzerland | 29/160.6 |
| 631127 | 10/1949 | United Kingdom | 72/256 |

OTHER PUBLICATIONS

"Metals and How to Weld Them", Jefferson and Woods, June, 1977, p. 90.

H. Bennett, F.A.I.C., "Concise Chemical and Technical Dictionary", 1974, p. 161.

G. Hawley, "The Condensed Chemical Dictionary", p. 122, Ninth Edition.

*Primary Examiner*—David Jones

*Attorney, Agent, or Firm*—Young & Thompson

[57] ABSTRACT

A process for the production of an elongated composite member of circular cross section, comprising producing a hollow metal tube having an inside diameter, inserting in the hollow tube an elongated core of circular cross section of a light-weight, tough and ductile material having an outer diameter substantially smaller than the internal diameter of the tube, and reducing the diameter of the tube until said tube is firmly bonded to the outer surface of the core. Thereafter, the diameter of the tube and core together is reduced. The core is of aluminum and the tube is of copper alloy. The composite thus produced is formed into a jewelry chain and then gold plated.

2 Claims, 1 Drawing Sheet

PROCESS FOR THE PRODUCTION OF CHAINS AND OTHER ORNAMENTAL ITEMS MADE OF A LINED TUBE BAR AND OF SIMILAR OBJECTS

The invention relates to the process for making chains and other ornamental items made of lined tube bar and similar objects like chains, collars, bracelets and others used to grace persons and goods like gabs, wallets and suits.

Bulky chains and ornaments are required either for the imitation jewelry field or to embellish suits, furs, imitation furs and generally fashion goods. Such ornaments are currently made of brass or other copper alloys that, at the end of the manufacturing process can be easily polished and coloured by treating the products in plating plants to coat their surface with a thin metallic film thus improving their appearance.

The items and especially the chains made in this way are rather heavy and therefore not always favoured by customers.

In order to reduce their weight and also to improve their aesthetics, such goods undergo fine grinding with diamond wheels.

This process, aimed to achieve a considerable reduction of their weight, is therefore essential to make the goods marketable.

On the other hand, the chain making machines cannot be fed with tubular bars because not only would the bars flatten during the different stages of the manufacturing process but, during the final polishing and/or colouring process, the links of the chains would also retain a large amount of the bath of each tank carrying it into the following baths that would be irreparably spoiled. The final treatment, in fact, consists basically in the degreasing, galvanic plating and washing stages.

Another process that could be used, but that is not currently employed because of its high costs, consists in starting from a plated bar, for instance an iron bar coated with brass or copper, wherein the core is dissolved with a chemical treatment at the end of the manufacturing process.

Other means used to obtain light-weight chains and ornamental items employ an aluminum bar. The appearance of the items thus produced is rather poor and it can be improved only through complex and expensive anodizing oxidation or special electrolytic processes in order to achieve a perfect cohesion of the galvanic coating to the aluminum surface which is rather difficult to obtain.

The process described in this patent overcomes the disadvantages of any of the currently used processes.

It consists in the use of a composite bar, whatever its cross section, that can be employed in the manufacture of chains and/or other items, coated either with brass or with copper alloys or with metals that can be easily treated with galvanic processes and provided with a light-weight, tough and ductile metallic or non metallic core.

In this way, the advantage of having mechanically strong items that can be safely machined without damages to their surface is achieved: these items can be easily processed in galvanic baths, achieving utmost uniformity and cohesion of the galvanic coating and avoiding any risk of bath pollution because the product, not being hollow, stepping from tank to tank, does not retain residue of the former bath. Last but not least, the items and especially the chains are light-weight and therefore can be manufactured in large sizes as required by fashion trends.

The above mentioned process is hereunder described with the aid of the accompanying drawing to be taken as examples:

Figure 1:
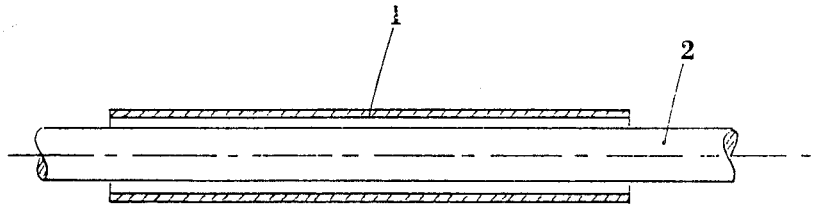
FIG. 1 is a view of a tube bar made of any kind of metal suitable to be treated with an electrochemical process cut along a longitudinal plane and with a core of light-weight, tough and ductile material.
Figure 2:
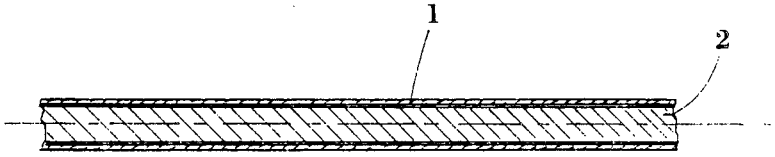
FIG. 2 is the view of a composite bar cut along a longitudinal plane wherein the two components are tightly fitting.
Figure 4:
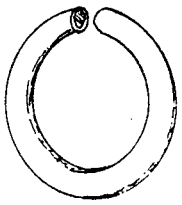
FIG. 4 is a perspective view of an open ring manufactured with the composite bar shown in FIG. 2 that can be used to make, for instance, an earring.
Figure 3:
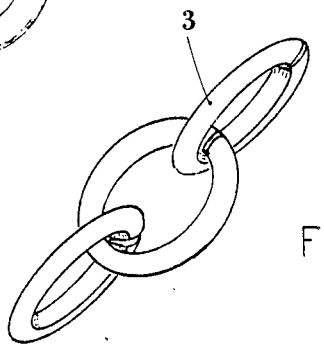
FIG. 3 is the view of a fragment of chain made with the composite bar shown in FIG. 2.

It must be pointed out that the drawing shows examples only to help in the description of the process and therefore cannot be considered as limiting the process itself.

In the drawing, the tubular bar made of any kind of metal suitable to be treated with an electrochemical process such as galvanic plating, like, for instance, copper alloys or even iron, is marked with number 1.

Number 2 indicates the supporting core that has to be light-weight, mechanically strong, like aluminum for instance, that is and suitable to be formed together with the coating tube (1) either when the composite bar is drawn and/or rolled, or in the subsequent manufacturing stages required to make chains or other ornamental objects.

The components 1 and 2 can be coupled by inserting the core 2 into the tubes when the composite bar has to be produced with a continuous process.

The composite bar is then rolled in order to achieve the perfect adhesion of the components, to lengthen the bar and to obtain eventually the correct cross section shape and size.

When the composite bar is brought to the required cross section it is used to feed the machines making the separate elements, like the links of a chain for instance or series of interlocked elements as required by the different kinds of chains.

If the chain or the elements are used only for ornamental purposes they can be treated with electrochemical processes to protect, polish and coat them with a thin film of suitable metals like gold, chromium, nickel or other, according to the required appearance.

The chains and other ornamental items made with the above described process appear to be homogeneous, solid and strong and, at the same time, are light-weight and are suitable for any application requiring light-weight and a finish aesthetically comparable to that of precious metals.

I claim:

1. A process for the production of an ornamental chain, comprising producing a hollow metal copper alloy tube having an inside diameter, inserting in said hollow tube an elongated aluminum core of circular cross section having an outer diameter substantially smaller than the internal diameter of said tube, reducing the diameter of said tube until said tube is firmly bonded to the outer surface of said core, and forming the composite member thus produced into an ornamental chain.

2. A process as claimed in claim 1, and electroplating said ornamental chain with an ornamental metal.

* * * * *